US011412855B2

(12) United States Patent
Kim et al.

(10) Patent No.: US 11,412,855 B2
(45) Date of Patent: Aug. 16, 2022

(54) FURNITURE AND METHODS OF STORAGE

(71) Applicant: Purdue Research Foundation, West Lafayette, IN (US)

(72) Inventors: Tong Jin Kim, West Lafayette, IN (US); Henry James Hathaway, West Lafayette, IN (US); Alexander M. Rockhold, West Lafayette, IN (US); Fernando Herrera, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 17/102,294

(22) Filed: Nov. 23, 2020

(65) Prior Publication Data

US 2021/0153658 A1 May 27, 2021

Related U.S. Application Data

(60) Provisional application No. 62/939,041, filed on Nov. 22, 2019.

(51) Int. Cl.

| | |
|---|---|
| ***A47C 4/00*** | (2006.01) |
| ***A47C 4/28*** | (2006.01) |
| ***A47C 17/04*** | (2006.01) |

(52) U.S. Cl.

CPC ..... *A47C 4/283* (2013.01); *A47C 17/04* (2013.01)

(58) Field of Classification Search

CPC ..... A47C 17/04; A47C 7/407; A47C 13/005; A47C 17/86; A47C 4/02

See application file for complete search history.

(56) References Cited

U.S. PATENT DOCUMENTS

| | | | | |
|---|---|---|---|---|
| 1,817,708 A * | 8/1931 | Pintow | A47C 17/162 297/110 |
| 2,790,485 A * | 4/1957 | Franklin | A47C 17/12 297/116 |
| 4,824,171 A * | 4/1989 | Hollingsworth | A47C 1/146 297/351 |
| 6,824,220 B1 * | 11/2004 | Davison | A47C 13/005 297/233 |
| 7,093,904 B1 * | 8/2006 | McMillen | A47C 7/543 297/411.37 |

(Continued)

*Primary Examiner* — Shin H Kim

(74) *Attorney, Agent, or Firm* — Hartman Global IP Law; Gary M. Hartman; Domenica N. S. Hartman

(57) ABSTRACT

Furniture configurable between a display configuration and a storage configuration that eases transport and storage and reduces the furniture footprint. The furniture includes an upper region that has seating and a backrest, and a lower region that is below the upper region and adapted to engage a support surface beneath the furniture when in the display configuration. In combination, the upper and lower regions define at least first and second sections of the furniture that are coupled by at least one hinge so that the first section comprises a first portion of the upper region and a first portion of the lower region and the second section comprises a second portion of the upper region and a second portion of the lower region, and the at least one hinge is configured so that the first and second sections pivot toward each other when the furniture is in the storage configuration.

17 Claims, 6 Drawing Sheets

(56) References Cited

U.S. PATENT DOCUMENTS

| | | | | |
|---|---|---|---|---|
| 8,894,138 | B2 * | 11/2014 | Monahan | A47C 4/08 297/44 |
| 9,241,575 | B2 * | 1/2016 | Wang | B65D 85/70 |
| 10,506,883 | B2 * | 12/2019 | Hirschhaut | A47C 4/02 |
| 11,076,700 | B2 * | 8/2021 | Kuhl | A47C 17/04 |
| 11,083,303 | B2 * | 8/2021 | Hirschhaut | A47C 4/02 |
| 11,147,385 | B1 * | 10/2021 | Kuhl | A47C 15/002 |
| 2002/0000740 | A1 * | 1/2002 | Laughlin | A47C 4/028 297/36 |
| 2005/0046243 | A1 * | 3/2005 | Cimino | A47C 13/005 297/124 |
| 2014/0352056 | A1 * | 12/2014 | Thu | A47C 17/165 5/13 |
| 2019/0350372 | A1 * | 11/2019 | Hirschhaut | A47C 17/04 |
| 2020/0113341 | A1 * | 4/2020 | Rodriguez | A47C 7/624 |
| 2020/0196751 | A1 * | 6/2020 | Wong | A47C 4/03 |
| 2020/0221877 | A1 * | 7/2020 | Hirschhaut | A47C 4/02 |
| 2020/0263427 | A1 * | 8/2020 | Madison | E04C 2/34 |
| 2021/0076832 | A1 * | 3/2021 | Gwee | A47C 19/024 |
| 2021/0321783 | A1 * | 10/2021 | Sodergren | A47C 13/005 |

* cited by examiner

FURNITURE AND METHODS OF STORAGE

CROSS REFERENCE TO RELATED APPLICATIONS

This patent application claims the benefit of U.S. Provisional Application No. 62/939,041, filed Nov. 22, 2019. The contents of this prior application are incorporated herein by reference.

BACKGROUND OF THE INVENTION

The present invention generally relates to furniture. The invention particularly relates to furniture having reduced storage footprints.

A current trend in furniture and interior decoration focuses on minimalist designs which use fewer building materials, result in limited environmental impact, have a reduced physical footprint suitable for smaller living spaces, and incorporate relatively simple designs. In addition, as many designers incorporate fewer pieces into their living spaces, their focus appears to be more directed toward unique and/or custom pieces. Furthermore, there is a desire for such furniture to be transportable and during transit or storage have a reduced footprint.

Accordingly, there is an ongoing desire for furniture that embodies one or more of the above trends.

BRIEF DESCRIPTION OF THE INVENTION

The present invention provides furniture that can be readily configured for ease of being transported and stored, and so that during transit or storage the furniture has a reduced footprint.

According to one aspect of the invention, a piece of furniture is provided that can be reconfigured between a storage configuration and a display configuration. The piece of furniture includes upper and lower regions. The upper region includes seating and a backrest that rises above the seating when the piece of furniture is in the display configuration. The lower region is below the upper region and adapted to engage a support surface beneath the piece of furniture when the piece of furniture is in the display configuration. In combination, the upper and lower regions define at least first and second sections of the piece of furniture that are coupled by at least one hinge so that the first section comprises a first portion of the upper region and a first portion of the lower region and the second section comprises a second portion of the upper region and a second portion of the lower region, and the at least one hinge is configured so that the first and second sections pivot toward each other when the piece of furniture is in the storage configuration.

According to another aspect of the invention, methods are provided for reconfiguring a piece of furniture as described above between the storage and display configurations. The methods entail, with the piece of furniture initially in the display configuration, pivoting the first and second sections toward each other to acquire the storage configuration.

Other aspects and advantages of the invention will be appreciated from the following detailed description.

DETAILED DESCRIPTION OF THE INVENTION

Figure 1A:
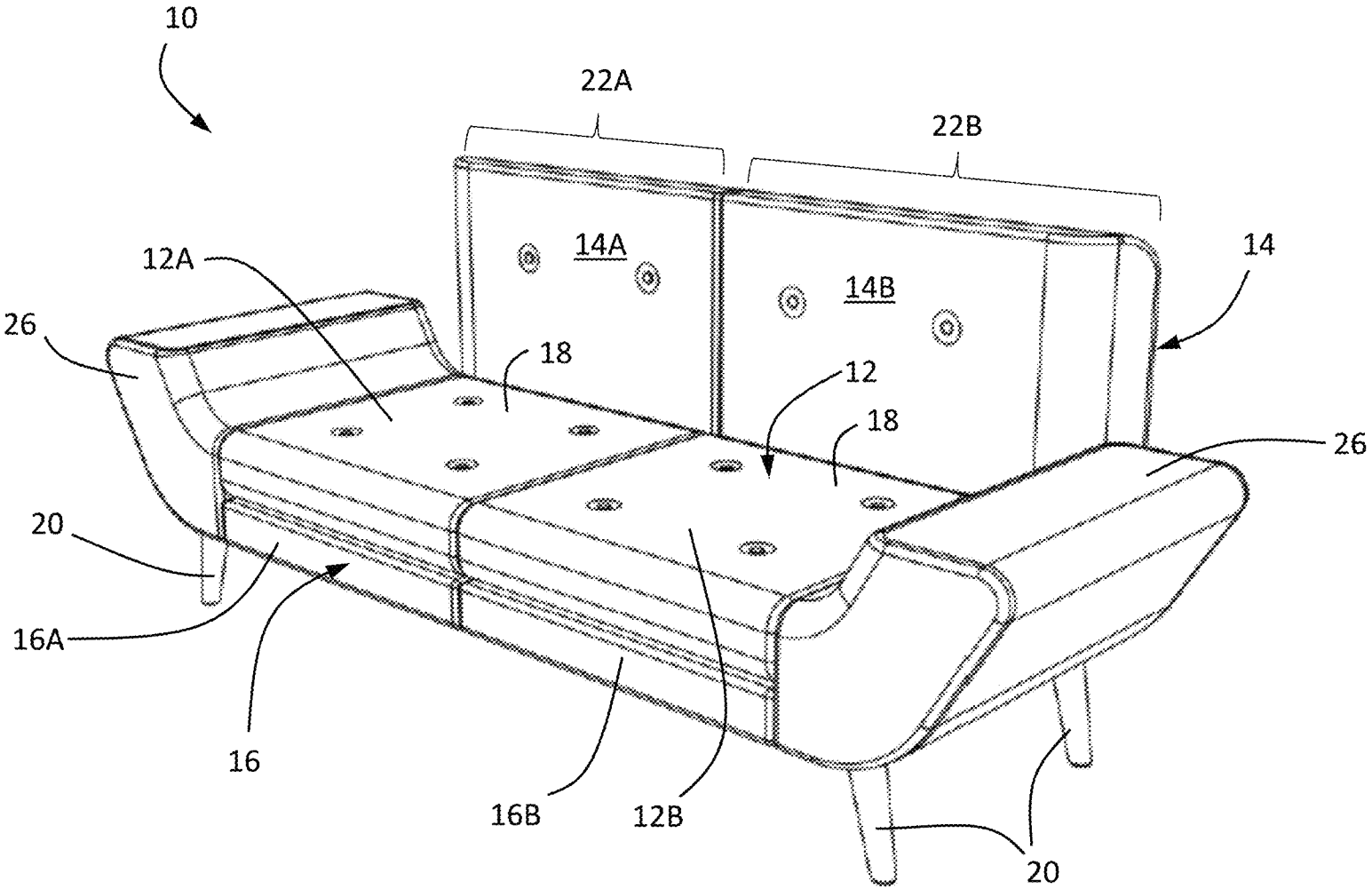
FIGS. 1A through 1E are, respectively, perspective, top, front elevational, bottom, and side elevational views showing a nonlimiting embodiment of a piece of furniture in a display configuration.
Figure 1B:
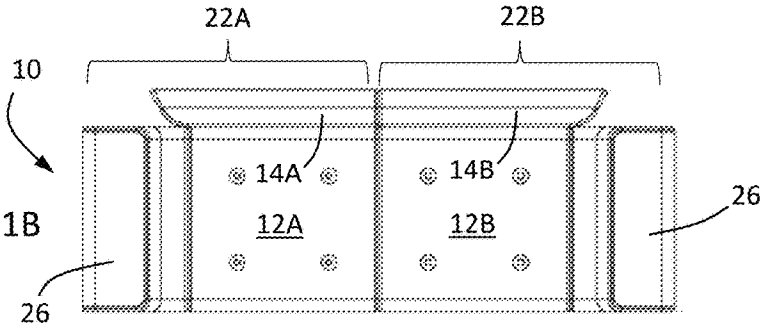
Figure 1C:
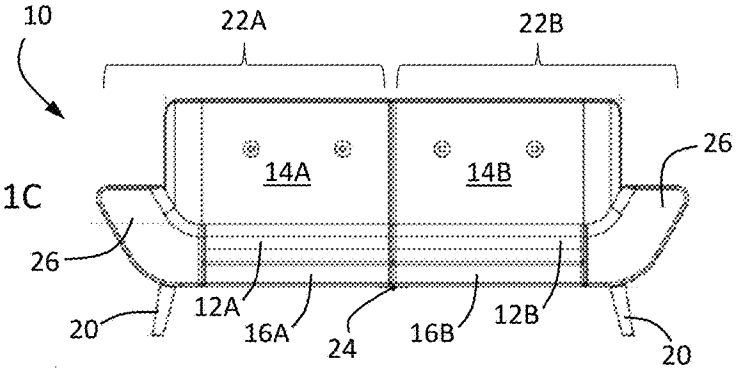

FIGS. 1A through 3H represent nonlimiting embodiments of collapsible pieces of furniture (sometimes simply referred to herein as furniture) that are configured to be selectively folded so as to be reconfigurable between a display configuration that provides seating for users and a storage configuration that facilitates transporting and storing of the pieces of furniture. The pieces of furniture are represented as sofas (which may be referred to as couches or lounges) 10 and 50, though it is foreseeable that other forms of furniture could be adapted to have structural characteristics shown in the drawings and discussed below.

To facilitate the descriptions provided below of the embodiments represented in FIGS. 1A through 3H, relative terms, including but not limited to, "vertical," "horizontal," "side," "upper," "lower," "longitudinal," "lateral," "above," "below," "right," "left," etc., may be used in reference to the perspective of an individual sitting in the sofas 10 and 50 when in their display configuration, and therefore are relative terms that are useful to describe the sofas 10 and 50 represented in the drawings, but should not be necessarily interpreted as limitations to the construction and use of the sofas 10 and 50.

Figure 1D:
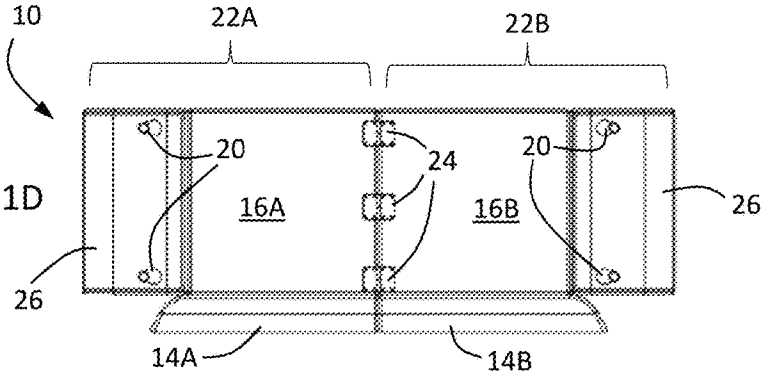
Figure 1E:
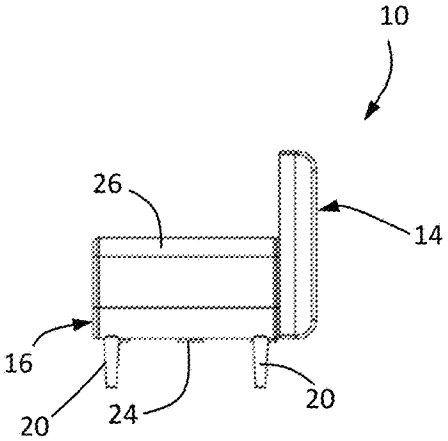
Figure 1G:
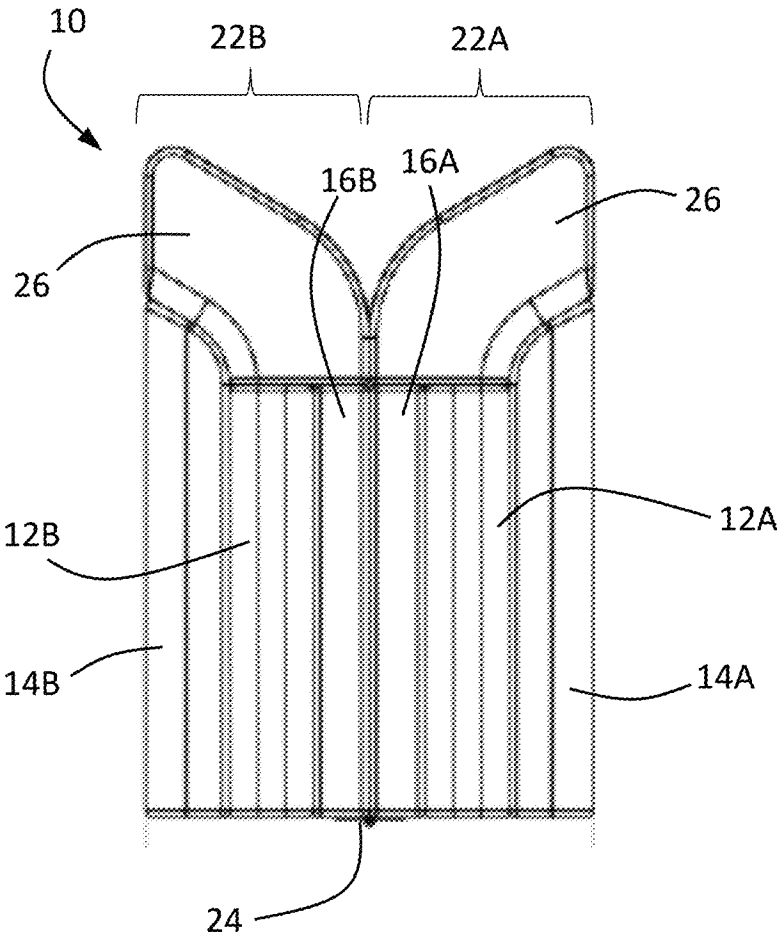
FIGS. 1F and 1G are two views of the same piece of furniture in a storage configuration.
Figure 1F:
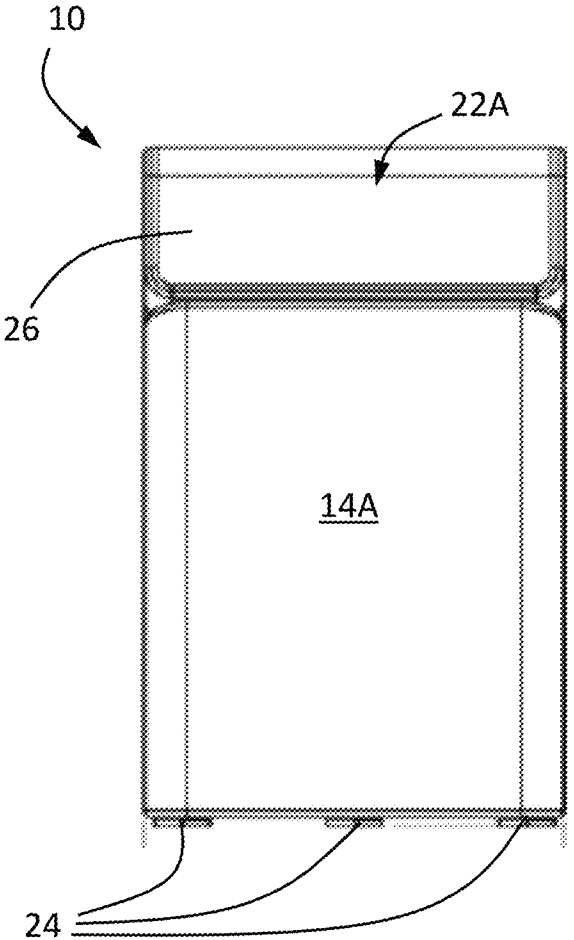

FIGS. 1A through 1E represent the sofa 10 in its display configuration, and FIGS. 1F and 1G represent the sofa 10 in its storage configuration. As evident from FIGS. 1A through 1E, the sofa 10 has an upper region 12 that provides seating for users, a backrest 14 that rises above the seating, and a lower region 16 that is below the upper region 12. The seating is in the form of cushions 18 that are, in this nonlimiting embodiment, permanently attached so that the cushions 18 define the upper surface of the upper region 12. Legs 20 are removably attached to and extend downwardly from a lower surface of the lower region 16 to be capable of engaging a support surface (e.g., a floor) beneath the sofa 10. In the embodiment shown, the upper and lower regions 12 and 16 are regions of a body or base of the sofa 10, and in combination the upper and lower regions 12 and 16 and the backrest 14 define first and second sections 22A and 22B of the sofa 10 that are coupled by one or more hinges 24 at the lower region 16 (FIG. 1D). In the embodiment shown, the first and second sections 22A and 22B are solely coupled by the hinges 24. As used herein, the term "hinge" can refer to various different types of hinges, including flexible hinges formed of flexible material that bend as the first and second sections 22A and 22B pivot relative to each other, and hinges formed of two or more mechanical components that are mechanically coupled to pivot relative to each other as the first and second sections 22A and 22B pivot relative to each other.

The first section 22A comprises a first portion 12A of the upper region 12, a first portion 16A of the lower region 16, and a first backrest portion 14A of the backrest 14, and the second section 22AB comprises a second portion 12B of the upper region 12, a second portion 16B of the lower region 16, and a second backrest portion 14B of the backrest 14. The first and second backrest portions 14A and 14B are preferably individually removable, for example, by detaching them from the base of the sofa 10 formed by the upper and lower regions 12 and 14. The hinges 24 are shown in FIG. 1D as configured so that the first and second sections 22A and 22B pivot toward each other when transitioning the sofa 10 from the display configuration to the storage configuration. Furthermore, the hinges 24 are located approximately midway between the longitudinal ends of the sofa 10 so that the sofa 10 is folded in half in the storage configuration. Additionally, FIG. 1G evidences that the hinges 24 are attached to the first and second portions 16A and 16B of the lower region 16 and located at the lower surfaces of the first and second portions 16A and 16B so that the first and second portions 16A and 16B are parallel to, face, and may abut each other in the storage configuration (FIG. 1G). FIGS. 1A through 1G further depict the sofa 10 as comprising armrests 26 that are located at oppositely-disposed longitudinal ends of the sofa 10 in the display configuration, and are adjacent each other but face away from each other (FIG. 1G) when the sofa 10 is in the storage configuration.

With the configuration shown in FIGS. 1A through 1G, starting with the sofa 10 in the display configuration (FIGS. 1A through 1E), the sofa 10 can be transitioned to the storage configuration (FIGS. 1F and 1G) by pivoting the sections 22A and 22B so that the first and second portions 16A and 16B of the lower region 16 rotate toward each other. Before or after pivoting the sections 22A and 22B, the two portions 14A and 14B of the backrest 14 can be detached and then placed against the upper portions 12A and 12B of the sections 22A and 22B so as to be nested within cavities defined by the upper portions 12A and 12B and the armrests 26, as shown in FIG. 1G. In addition, FIGS. 1F and 1G represent the legs 20 as having been previously removed to increase the compactness of the storage configuration by enabling the first and second portions 16A and 16B of the lower region 16 to be parallel to and abut each other face to face in the storage configuration (FIG. 1G). The resulting storage configuration shown in FIGS. 1F and 1G is roughly rectangular cuboid in shape and therefore can be placed in a box, crate, or other shipping container for transport or storage.

Figure 2A:
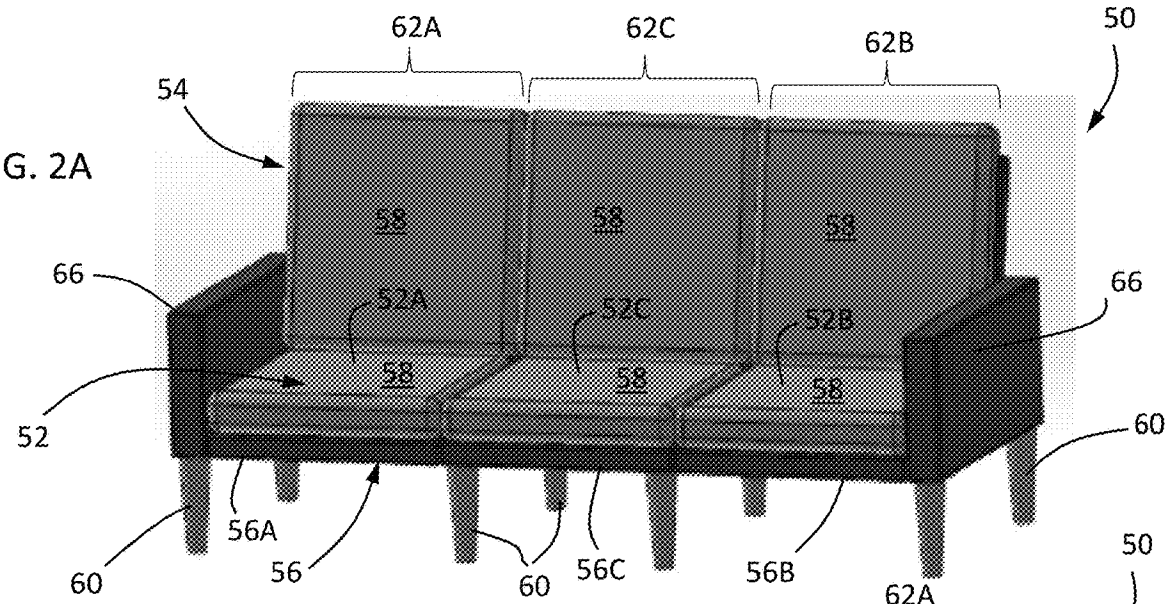
FIGS. 2A and 2B are, respectively, front and rear perspective views showing another nonlimiting embodiment of a piece of furniture in a display configuration.
Figure 2B:
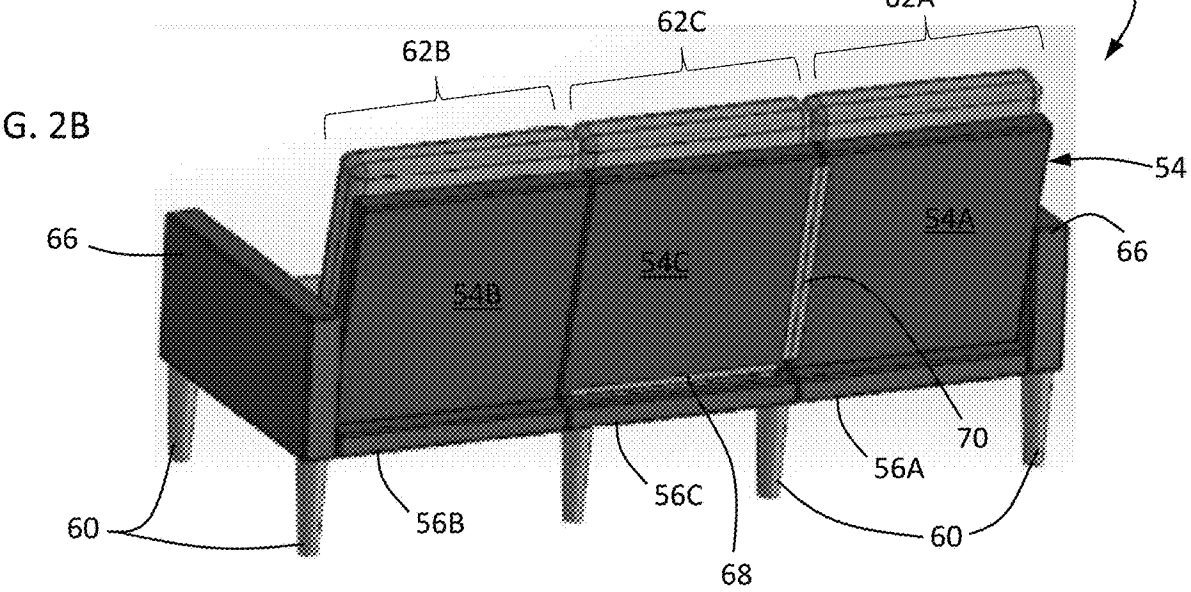
Figures 3A, 3B, 3C, 3D:
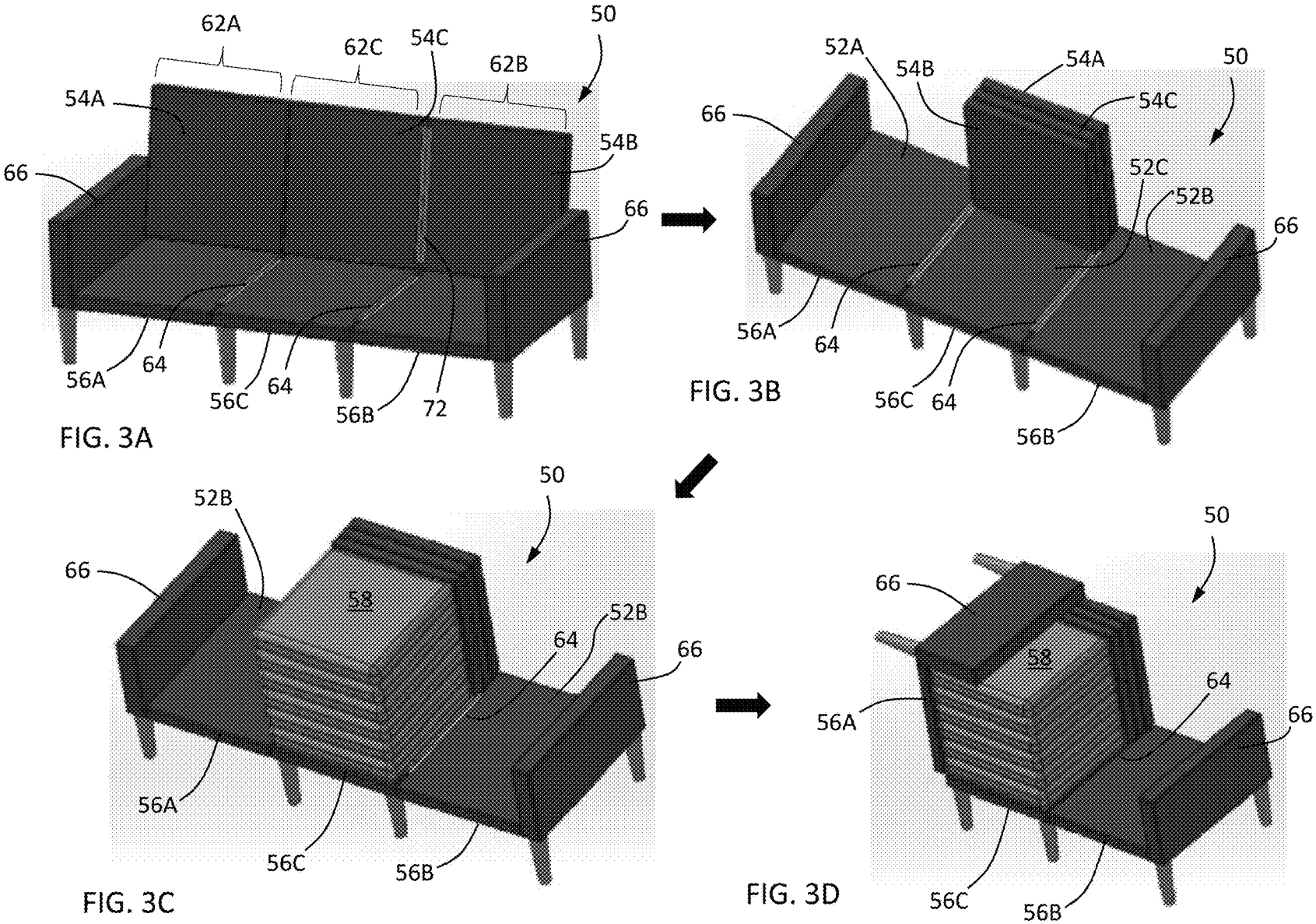
FIGS. 3A through 3H represent steps by which the piece of furniture of FIGS. 2A and 2B can be transitioned from the display configuration (FIG. 3A) to a storage configuration (FIG. 3H).
Figures 3E, 3F, 3G, 3H:
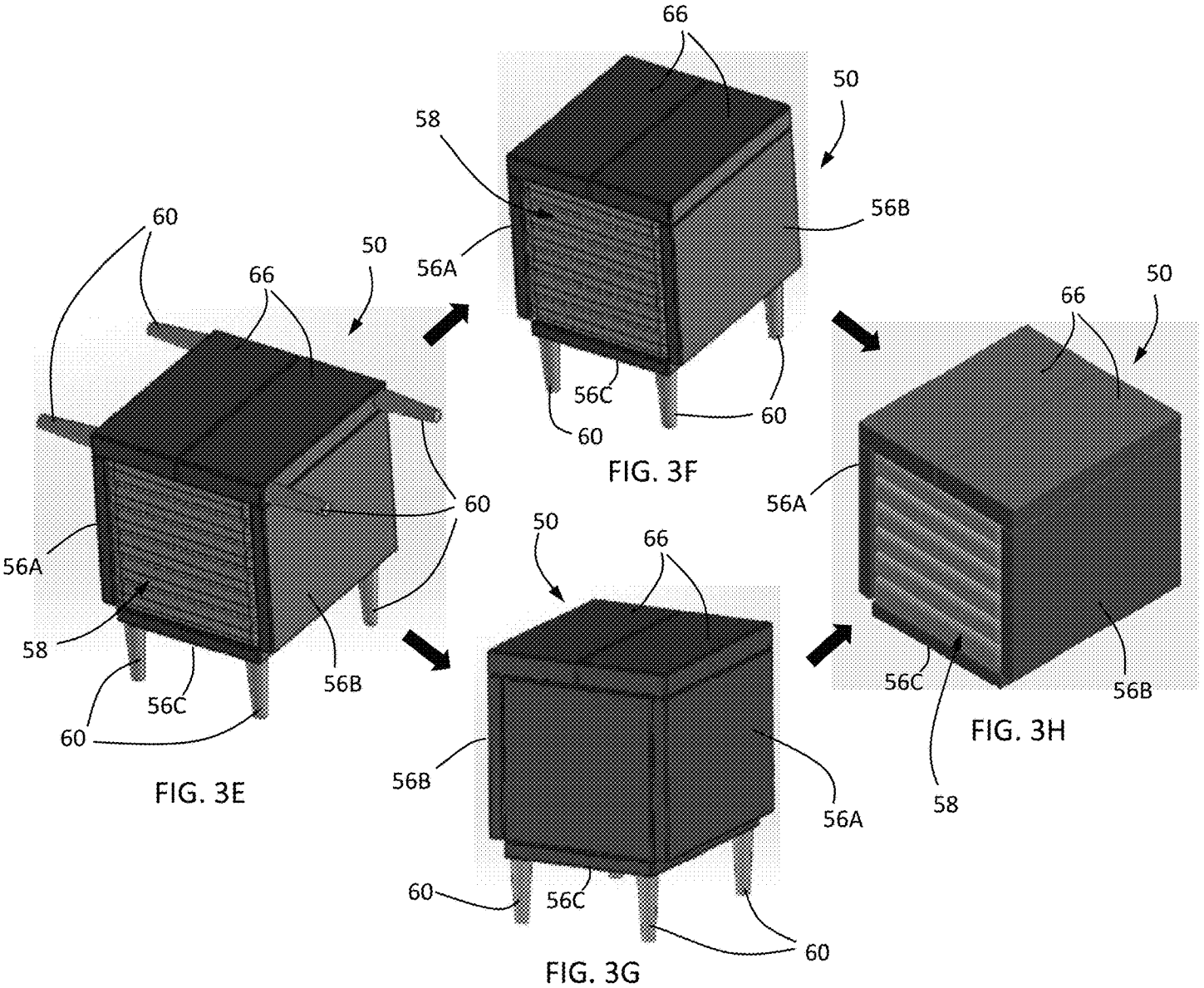

FIGS. 2A, 2B, and 3A through 3H represent a sofa 50 in accordance with another embodiment, in which the sofa 50 is represented in a display configuration in FIGS. 2A, 2B, and 3A, and in the storage configuration in FIG. 3H. As with the previous embodiment of FIGS. 1A through 1G, the upper region 52 of the sofa 50 provides seating for users and a backrest 54 that rises above the seating, the lower region 56 of the sofa 50 is below the upper region 52, and legs 60 are attached to and extend downwardly from the lower region 56 to engage a support surface (e.g., a floor) beneath the sofa 50. In contrast to the embodiments of FIGS. 1A through 1G, the embodiment of FIGS. 2A through 3H comprises a third section 62C between first and second sections 62A and 62B, such that the third section 62C comprises a third portion 52C of the upper region 52 and a third portion 16C of the lower region 56. Also in contrast, the seating is in the form of cushions 58 that are, in this nonlimiting embodiment, removable, and hinges 64 are located in the upper region 52 of the sofa 50 to pivotally couple the third section 62C to each of the first and second sections 62A and 62B. As evidenced by the transition from the display configuration of FIG. 3A to the storage configuration of FIG. 3H, the first and second sections 62A and 62B are parallel to and face each other and the third section 62C is perpendicular to the first and second sections 62A and 62B in the storage configuration. As also shown, the hinges 64 may be located between the first, second, and third sections 62A, 62B, and 62C so that the sofa 50 is folded in approximate thirds in the storage configuration.

Whereas the two portions 14A and 14B of the backrest 14 of the embodiment of FIGS. 1A through 1G are removable, the backrest 54 shown in FIGS. 2A, 2B, and 3A through 3H comprises first, second, and third backrest portions 54A, 54B, and 54C located in, respectively, the first, second, and third sections 62A, 62B, and 62C. The third backrest portion 54C is pivotally connected to the third portion 56C of the lower region 56, as evidenced by a hinge 68 visible in FIG. 2B. Furthermore, the first backrest portion 54A is pivotally connected to the third backrest portion 54C as evidenced by a hinge 70 visible in FIG. 2B, and the second backrest portion 54B is pivotally connected to the third backrest portion 54C as evidenced by a hinge 72 visible in FIG. 3A. With this arrangement, the backrest portions 54A-C are able to be folded onto each other in the storage configuration, as seen in FIG. 3B.

As evidenced by the transition from the display configuration of FIG. 3A to the storage configuration of FIG. 3H, in the storage configuration the first and second portions 52A and 52B of the upper region 52 (as well as the first and second portions 56A and 56B of the lower region 56) are parallel to and spaced apart from each other to define a storage cavity therebetween, and the third portions 52C and 56C of the upper and lower regions 52 and 56 are perpendicular to the first and second portions 52A and 52B of the upper region 52 and the first and second portions 56A and 56B of the lower region 56. The storage cavity and the third portion 52C of the upper region 52 are preferably sized to entirely accommodate the removable cushions 58 that are otherwise placed on the seating and backrest 54 of the sofa 50 in the display configuration, as seen in 2A through 3H. As also evident from the transition represented in FIGS. 3A through 3H, the storage cavity is enclosed on three sides by the first, second, and third portions 52A, 52B, and 52C of the upper region 52, on a fourth side by the first, second, and third backrest portions 54A-C folded onto each other, and on a fifth side by armrests 66 that are at oppositely-disposed longitudinal ends of the sofa 50 in the display configuration and are adjacent and face each other in the storage configuration.

Due to the different locations of its hinges 64 at the upper region 52, pivoting of the sofa 50 of FIGS. 3A through 3H is opposite that of the sofa 10 represented in FIGS. 1A through 1G, namely, starting with the sofa 50 in the display configuration (FIG. 3A), and after the first and second backrest portions 54A and 54B have been folded onto the third backrest portion 54C (FIGS. 3B and 3C), the first and second sections 62A and 62B are pivoted toward each other so that their upper portions 52A and 52B face each other (FIGS. 3D and 3E) to acquire the storage configuration and define therebetween the storage cavity. A comparison of FIGS. 3E through 3G to FIG. 3H evidences that, similar to the embodiments of FIGS. 1A through 1G, the lower region 56 of the sofa 50 is equipped with removable legs 60 that, once removed as shown in FIG. 3H, increases the compactness of the storage configuration. The resulting storage configuration shown in FIG. 3H is roughly rectangular cuboid in shape and therefore can be placed in a box, crate, or other shipping container for transport or storage.

While the invention has been described in terms of specific or particular embodiments, it is apparent that other forms could be adopted by one skilled in the art. For example, the sofas 10 and 50 and their respective components could differ in appearance and construction from the embodiments described herein and shown in the drawings, functions of certain components of the sofas 10 and 50 could be performed by components of different construction but capable of a similar (though not necessarily equivalent) function, and various materials could be used in the manufacturing of the sofas 10 and 50 and their components. As such, it should be understood that the intent of the above detailed description is to describe the particular embodiments represented in the drawings and certain but not necessarily all features and aspects thereof, and to identify certain but not necessarily all alternatives to the particular embodiments represented in the drawings. As a nonlimiting example, the invention encompasses additional or alternative embodiments in which one or more features or aspects of a particular embodiment could be eliminated or two or more features or aspects of different described embodiments could be combined. Accordingly, it should be understood that the invention is not necessarily limited to any particular embodiment described herein or illustrated in the drawings. It should also be understood that the purpose of the above detailed description and the phraseology and terminology employed therein is to describe the illustrated embodiments represented in the drawings, and not necessarily to serve as limitations to the scope of the invention. Therefore, the scope of the invention is to be limited only by the following claims.

The invention claimed is:

1. A piece of furniture that has a display configuration and a storage configuration, the piece of furniture comprising:

an upper region comprising seating and a backrest that rises above the seating when the piece of furniture is in the display configuration; and a lower region that is below the upper region and adapted to engage a support surface beneath the piece of furniture when the piece of furniture is in the display configuration;

wherein the upper and lower regions in combination define at least first and second sections of the piece of furniture that are coupled by at least one hinge so that the first section comprises a first portion of the upper region and a first portion of the lower region and the second section comprises a second portion of the upper region and a second portion of the lower region, and the at least one hinge is configured so that the first and second sections pivot toward each other when the piece of furniture is in the storage configuration;

wherein the upper and lower regions in combination define a third section between the first and second sections, the third section comprises a third portion of the upper region and a third portion of the lower region, and the at least one hinge comprises first and second hinges located in the upper region that couple the third section to the first and second sections, respectively;

wherein the backrest comprises first, second, and third backrest portions located in, respectively, the first, second, and third sections when in the display configuration; and wherein the first and second backrest portions are each pivotally connected to the third backrest portion.

2. The piece of furniture of claim 1, wherein the at last one hinge is located in the lower region and the first and second portions of the lower region are parallel to and face each other in the storage configuration.

3. The piece of furniture of claim 1, wherein the piece of furniture is a sofa.

4. A method of storing the piece of furniture of claim 1, the method comprising, with the piece of furniture initially in the display configuration, pivoting the first and second portions of the lower region toward each other to acquire the storage configuration.

5. The piece of furniture of claim 1, wherein in the storage configuration the seating in the first and second portions of the upper region are parallel to and face each other and the seating in the third portion of the upper region is perpendicular to the first and second portions of the upper region.

6. The piece of furniture of claim 1, further comprising first and second armrests at oppositely-disposed longitudinal ends of the piece of furniture in the display configuration, wherein the first and second armrests are adjacent and face each other when the piece of furniture is in the storage configuration.

7. The piece of furniture of claim 1, wherein the first hinge is located between the first and second sections and the second hinge is located between the second and third sections so that the piece of furniture is folded in thirds in the storage configuration.

8. The piece of furniture of claim 1, wherein the backrest comprises first, second, and third backrest portions located in, respectively, the first, second, and third sections when in the display configuration.

9. The piece of furniture of claim 8, wherein the third backrest portion is pivotally connected to the third portion of the upper region.

10. A piece of furniture that has a display configuration and a storage configuration, the piece of furniture comprising:

an upper region comprising seating and a backrest that rises above the seating when the piece of furniture is in the display configuration;

a lower region that is below the upper region and adapted to engage a support surface beneath the piece of furniture when the piece of furniture is in the display configuration; and first and second armrests at oppositely-disposed longitudinal ends of the piece of furniture in the display configuration;

wherein the upper and lower regions in combination define at least first and second sections of the piece of furniture that are coupled by at least one hinge so that the first section comprises a first portion of the upper region and a first portion of the lower region and the second section comprises a second portion of the upper region and a second portion of the lower region, and the at least one hinge is configured so that the first and second sections pivot toward each other when the piece of furniture is in the storage configuration;

wherein the first and second armrests are adjacent but face away from each other when the piece of furniture is in the storage configuration;

wherein the first section comprises a first seating portion of the seating and a first backrest portion of the backrest, the second section comprises a second seating portion of the seating and a second backrest portion of the backrest, and the first and second backrest portions are detachable and placeable against the first and second seating portions so as to be nested within cavities defined by the first and second seating and the first and second armrests in the storage configuration.

11. The piece of furniture of claim 10, wherein the at least one hinge is located midway between oppositely-disposed longitudinal ends of the piece of furniture so that the piece of furniture is folded in half in the storage configuration.

12. A piece of furniture that has a display configuration and a storage configuration, the piece of furniture comprising:

an upper region comprising seating and a backrest that rises above the seating when the piece of furniture is in the display configuration;

a lower region that is below the upper region and adapted to engage a support surface beneath the piece of furniture when the piece of furniture is in the display configuration;

wherein the upper and lower regions in combination define at least first and second sections of the piece of furniture that are coupled by at least one hinge so that the first section comprises a first portion of the upper region and a first portion of the lower region and the second section comprises a second portion of the upper region and a second portion of the lower region, and the at least one hinge is configured so that the first and second sections pivot toward each other when the piece of furniture is in the storage configuration;

wherein the upper and lower regions in combination define a third section between the first and second sections, the third section comprises a third portion of the upper region and a third portion of the lower region, and the at least one hinge comprises first and second hinges located in the upper region that couple the third section to the first and second sections, respectively; and wherein in the storage configuration the first and second portions of the upper region are parallel to and spaced apart from each other to define a storage cavity therebetween, and the third portion of the upper region is perpendicular to the first and second portions of the upper region;

wherein the piece of furniture further comprises removable cushions located in the first, second, and third sections, wherein the storage cavity is sized to entirely accommodate the cushions in the storage configuration.

13. The piece of furniture of claim 12, wherein the piece of furniture is a sofa.

14. A method of storing the piece of furniture of claim 12, the method comprising, with the piece of furniture initially in the display configuration, pivoting the first and second sections toward each other to acquire the storage configuration.

15. A piece of furniture that has a display configuration and a storage configuration, the piece of furniture comprising:

an upper region comprising seating and a backrest that rises above the seating when the piece of furniture is in the display configuration;

a lower region that is below the upper region and adapted to engage a support surface beneath the piece of furniture when the piece of furniture is in the display configuration; and wherein the upper and lower regions in combination define at least first and second sections of the piece of furniture that are coupled by at least one hinge so that the first section comprises a first portion of the upper region and a first portion of the lower region and the second section comprises a second portion of the upper region and a second portion of the lower region, and the at least one hinge is configured so that the first and second sections pivot toward each other when the piece of furniture is in the storage configuration;

wherein the upper and lower regions in combination define a third section between the first and second sections, the third section comprises a third portion of the upper region and a third portion of the lower region, and the at least one hinge comprises first and second hinges located in the upper region that couple the third section to the first and second sections, respectively; and wherein in the storage configuration the first and second portions of the upper region are parallel to and spaced apart from each other to define a storage cavity therebetween, and the third portion of the upper region is perpendicular to the first and second portions of the upper region; and wherein the backrest comprises first, second, and third backrest portions located in, respectively, the first, second, and third sections when in the display configuration, the third backrest portion is pivotally connected to the third portion of the upper region, the first and second backrest portions are each pivotally connected to the third backrest portion, and the first, second, and third backrest portions are folded onto each other in the storage configuration.

16. The piece of furniture of claim 15, wherein in the storage configuration the storage cavity is enclosed on three sides by the first, second, and third portions of the upper region, on a fourth side by the first, second, and third backrest portions folded onto each other, and on a fifth side by armrests that are at oppositely-disposed longitudinal ends of the piece of furniture in the display configuration and are adjacent and face each other in the storage configuration.

17. The piece of furniture of claim 15, wherein the piece of furniture is a sofa.

* * * * *